United States Patent [19]

Brothers

[11] Patent Number: 4,908,944

[45] Date of Patent: Mar. 20, 1990

[54] STRAP-SEVERING TOOL

[76] Inventor: Jack Brothers, 806 Tuxedo Dr., Fort Walton Beach, Fla. 32548

[21] Appl. No.: 288,818

[22] Filed: Dec. 23, 1988

[51] Int. Cl.[4] ..... B26B 11/00

[52] U.S. Cl. ..... 30/2; 30/278; 30/280; 30/348

[58] Field of Search ..... 30/2, 124, 165, 280, 30/289, 278, 296 R, 314, 443, 348; 81/3.07, 3.4, 3.41

[56] References Cited

U.S. PATENT DOCUMENTS

| | | | |
|---|---|---|---|
| 851,708 | 4/1907 | Taylor | 30/348 |
| 2,711,109 | 6/1955 | Gillstrom | 30/165 |
| 3,791,031 | 2/1974 | Brothers et al. | 30/296 R X |
| 3,831,280 | 8/1974 | Brothers et al. | 30/296 R |
| 4,092,112 | 5/1978 | Calkins et al. | 30/443 X |
| 4,205,440 | 6/1980 | Morgan | 30/2 X |

*Primary Examiner*—Hien H. Phan
*Assistant Examiner*—Y. Lin
*Attorney, Agent, or Firm*—Bernard J. Murphy

[57] ABSTRACT

The tool is formed of a pair of planar webs which are spaced apart, in a parallel disposition, and are joined, along common sides thereof, in a spine. One of the webs has a diagonal cutting edge formed therealong, and the other thereof is integral with an apertured tab which extends therefrom in an obtuse angle. The web with the cutting edge further has an upturned lip which closes into proximate interface with the other web. Ends of strapping are slid into the tool, after having been enwrapped about a crate, box, stack of lumber, or the like. The tool can be crimped, to secure the strap ends therein, or the strapping can be crimped elsewhere, for or aft of the tool. When the strapped crate, box, or whatever, needs to be opened, one has only to insert a tire iron, rifle barrel, or the like, into the aperture of the tab and, bearing against the tool with the end thereof, pull the cutting edge across the strapping to sever the same.

8 Claims, 2 Drawing Sheets

STRAP-SEVERING TOOL

This invention pertains to tools used for severing strapping, such as the metal strapping which is used to band the sides of crates, boxes, stacks of lumber, and the like, and in particular to a tool so designed as to accommodate its banding to a crate, or such, for travel therewith, in engagement with the strapping, and having a cutting edge, the tool being manipulatable for severing the strapping with the cutting edge.

Tools of the type to which the invention pertains are perhaps best exemplified by that disclosed in U.S. Pat. No. 3,831,280, for a Strapping Severing Tool, which issued on Aug. 27, 1974, to myself and co-inventor Walter J. Puzia. By way of explaining the general functioning and manipulation of the instant invention, the aforesaid patent is incorporated herein by reference.

My instant strap-severing tool comprises a body; said body having (a) a given longitudinal axis, and (b) a pair of substantially planar webs of generally quadrilateral conformation; wherein said webs are (a) spaced apart in a parallel relationship, and (b) joined along first, given and complementary sides thereof in an axially extended spine; one of said webs having a termination in a cutting edge; further including a lip extending substantially normal to, and being integral with, one of said webs; said lip having a surface which defines a proximate interface with an opposite, second side of the other of said webs; and an apertured tab, integral with, and angularly extending from said other web; wherein said tab and said other web together have means buttressing said tab to said other web.

The novel features of the ivention will become apparent by reference to the following description taken in conjunction with the accompanying figures, in which.

Figure 1:
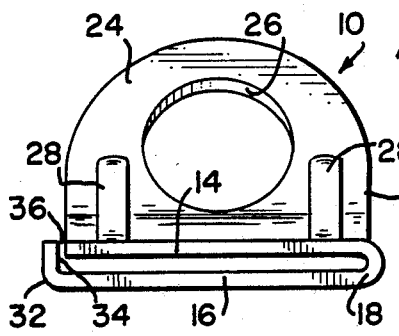
FIG. 1 is a front, elevational view of an embodiment of the novel tool.
Figure 5:
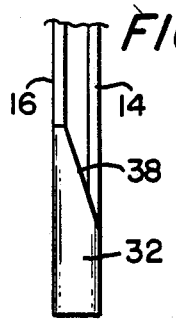
FIG. 5 is a partial side view thereof, taken from 5—5 of FIG. 4.
Figure 2:
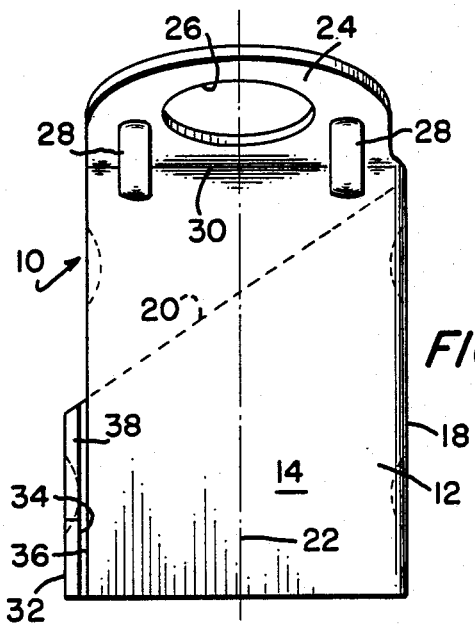
FIG. 2 is a plan view thereof.
Figure 3:
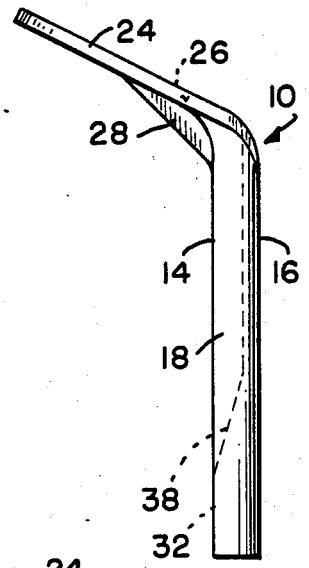
FIG. 3 is a side elevational view thereof, taken from the right-hand side of FIG. 2.
Figure 4:
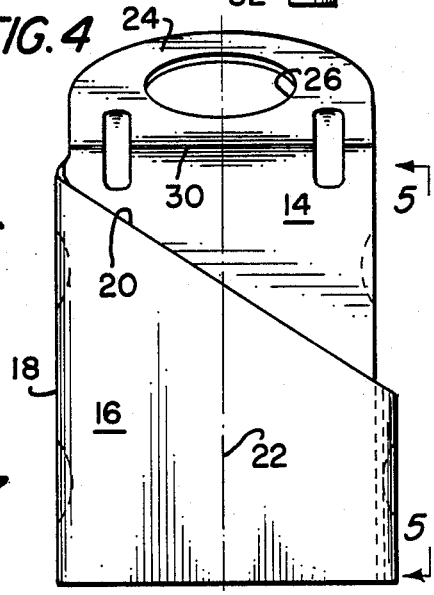
FIG. 4 is an opposite plan view of the tool.

As shown in the figures, the novel tool 10, according to an embodiment thereof, comprises a body 12 formed of a pair of webs 14 and 16. The webs 14 and 16 are joined at one common side thereof in a spine 18. The webs 14 and 16 are of a generally quadrilateral conformation, and are fixed in a spaced apart, parallel relationship. The web 16 has a cutting edge 20 formed thereon, as a termination thereof, which traverses the longitudinal axis 22 of the tool 10. A tab 25, having an aperture 26 formed therein, in integral with, and extends from, web 14. The tab 24 rises at an obtuse angle from web 14, and the web 14 and tab 24 together have a pair of ribs 28 formed therein which bridge across the obtuse-angle joint 30 which obtains therebetween. The ribs buttress the joint and strengthen the tab 24.

The web 16 has a lip 32 which has a surface 34 which defines a proximate interface with a lateral edge 36 of web 14, as can be seen, the lip 32, upturned from the plane of web 16, will capture strapping ends in the tool. Further, the lip 32 has a sloping surface 38 which extends to, and terminates at, the cutting edge 20. This sloping surface provides a guide to facilitate entry of strapping into the tool between the webs 14 and 16.

Figure 6:
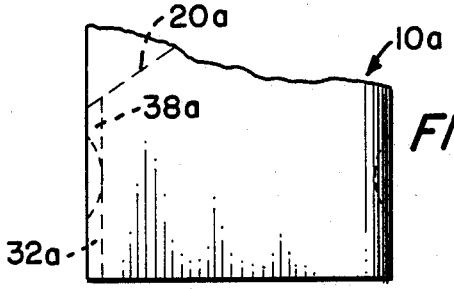
FIG. 6 is a partial view, corresponding to that of FIG. 2, of an alternative embodiment of the tool.
Figure 7:
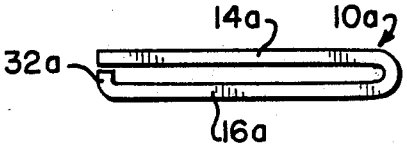
FIG. 7 is a front elevational view of only the webs of the alternative embodiment of FIG. 6.

In FIGS. 6 and 7, which depict an alternative embodiment of the invention, same or similar index numbers as are used in FIGS. 1–5 denote same or similar structures. The tool embodiment 10a, of FIGS. 6 and 7, is the same in most respects as the embodiment 10, except with respect to the lip **32*a*. Herein, lip 32*a* rises from the web 16*a* to interface or confront the underlying surface of the web 14*a***.

Optionally, crimp clips may be used, fore and/or aft of the tools 10 or **10*a* to clasp the strapping ends. Preferably, and in order to dispense with the use of separate crimp clips, the tools 10 and 10*a* can be crimped to serve the same purposes. Such crimping of the tools 10 and 10*a* is shown, in arcuate, dashed lines on opposite sides of the tools in FIGS. 2, 4 and 6**.

The tools 10 and **10*a* are used, quite like the tool in the aforsaid prior patent of mine, except that with the instant invention, one has only to insert an end of a tire iron, rifle barrel, or the like, into the aperture 26 and by bearing down on the center of the web 14, raise the tool 10 or 10*a* to cause the cutting edge 20** to serve the enclosed strapping ends.

While I have described my invention in connection with specific embodiments thereof it is to be clearly understood that this is done only by way of example, and not as a limitation to the scope of the invention, as set forth in the appended claims.

I claim:

1. A strap-severing tool, comprising:

a body;

said body having (a) a given longitudinal axis, and (b) a pair of substantially horizontal planar webs of generally quadrilateral conformation; wherein said webs are (a) vertically spaced apart in a parallel relationship, and (b) together jointed only along first one side thereof by in an axially extended spine;

one of said webs having a termination in a cutting edge; further including a lip extending substantially normal to, and being integral with, one of said webs;

said lip having a surface which defines a proximate interface with an opposite, second side of the other of said webs; and an apertured tab, integral with, an angularly extending from, said other web; wherein said tab and said other web together have means buttressing said tab to said other web.

2. A strap-severing tool, according to claim 1, wherein:

said cutting edge and said lip are coextensively continuous.

3. A strap-severing tool, according to claim 1, wherein:

said tab and said other web define an obtuse angular joint therebetween; and said buttressing means comprises means bridging across said joint.

4. A strap-severing tool, according to claim 3, wherein:

said bridging means comprises a rib.

5. A strap-severing tool, according to claim 3, wherein:

said bridging means comprises a plurality of ribs.

6. A strap-severing tool, according to claim 2, wherein:

said cutting edge lies in a first plane;

said surface of said lip lies in a second plane which is parallel with said first plane; and said lip further has a sloping surface which terminates at said cutting edge.

7. A strap-severing tool, according to claim 1, wherein:

said other web has an uppermost surface, and an opposite, underlying surface; and said surface of said lip defines said interface with said underlying surface of said other web.

8. A strap-severing tool, according to claim 1, wherein:

said second side of said other web has a lateral edge; and said surface of said lip defines said interface with said lateral edge of said other web.

* * * * *